US007195538B2

(12) United States Patent
Tanaka

(10) Patent No.: US 7,195,538 B2
(45) Date of Patent: Mar. 27, 2007

(54) EYEGLASS LENS PROCESSING APPARATUS

(75) Inventor: Motoshi Tanaka, Gamagori (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 11/476,614

(22) Filed: Jun. 29, 2006

(65) Prior Publication Data

US 2007/0004317 A1 Jan. 4, 2007

(30) Foreign Application Priority Data

Jun. 30, 2005 (JP) ..... P2005-193073

(51) Int. Cl.
*B24B 49/00* (2006.01)

(52) U.S. Cl. ..... 451/5; 451/42; 451/11

(58) Field of Classification Search ..... 451/5, 451/8–11, 42, 240, 255, 256, 277, 323
See application file for complete search history.

(56) References Cited

U.S. PATENT DOCUMENTS

| | | | | |
|---|---|---|---|---|
| 4,312,618 | A | 1/1982 | Greene | |
| 5,333,412 | A | 8/1994 | Matsuyama | |
| RE35,898 | E | 9/1998 | Shibata et al. | |
| 6,159,072 | A | 12/2000 | Shibata | |
| 6,623,339 | B1 * | 9/2003 | Igarashi et al. | 451/42 |
| 6,702,653 | B2 * | 3/2004 | Shibata | 451/42 |
| 6,790,124 | B2 * | 9/2004 | Shibata | 451/42 |
| 6,859,336 | B1 * | 2/2005 | Wada et al. | 359/819 |
| 6,913,510 | B2 | 7/2005 | Mizuno et al. | |
| 6,942,542 | B2 * | 9/2005 | Shibata | 451/5 |
| 7,083,498 | B2 * | 8/2006 | Jinbo et al. | 451/8 |

FOREIGN PATENT DOCUMENTS

| | | |
|---|---|---|
| DE | 38 09 565 C1 | 2/1989 |
| DE | 195 37 692 A1 | 4/1997 |
| DE | 197 36 789 A1 | 3/1999 |
| DE | 10 2004 037 879 A1 | 3/2005 |
| EP | 0 511 394 A1 | 11/1992 |
| EP | 0 974 422 A1 | 1/2000 |
| EP | 1 155 775 A2 | 11/2001 |
| JP | 4-93164 | 3/1992 |
| JP | 5-212661 | 8/1993 |
| JP | 10-138107 | 5/1998 |
| JP | 2004-34166 | 2/2004 |
| JP | 2004-237389 | 8/2004 |

* cited by examiner

*Primary Examiner*—Dung Van Nguyen
(74) *Attorney, Agent, or Firm*—Sughrue Mion, PLLC

(57) ABSTRACT

An eyeglass lens processing apparatus includes: a processing tool that processes a periphery of an eyeglass lens; a lens chucking shaft that holds the lens; a rotating unit that rotates the chucking shaft; a first moving unit that relatively moves the chucking shafts with respect to the processing tool; a lens holding arm that is provided with first and second lens holders for holding the lenses; a second moving unit that moves the lens holding arm; and a controller that controls the first and second moving units so that the first lens holder and the chucking shaft are moved to a first transfer position to transfer the lens therebetween, and, following the processing of the lens which is held by the first lens holder, the second lens holder and the chucking shaft are moved to a second transfer position to transfer the lens therebetween.

9 Claims, 8 Drawing Sheets

EYEGLASS LENS PROCESSING APPARATUS

BACKGROUND OF THE INVENTION (1) Technical Field

The present invention relates to an eyeglass lens processing apparatus for processing the eyeglass lenses.

(2) Related Art

In an eyeglass lens processing apparatus, each of the eyeglass lenses is held (chucked) between two lens chucking shafts and rotated, and a periphery of the lens is processed by a processing tool such as a grindstone so as to substantially fit a target lens shape. In the processing apparatus, a pair of lenses for right and left eyes are continuously processed in many cases. However, because the chucking shafts can hold only one lens, after one of the lenses has been processed, the lens must be removed from the chucking shafts, and the other lens must be held by the chucking shafts. This is annoying.

SUMMARY OF THE INVENTION

A technical problem of the invention is to provide an eyeglass lens processing apparatus which can process the lenses efficiently with a simple structure.

In order to solve the above described problem, the invention is characterized by comprising the following structures.

(1) An eyeglass lens processing apparatus comprising:

a processing tool that processes a periphery of an eyeglass lens;

a lens chucking shaft that holds the eyeglass lens;

a rotating unit that rotates the chucking shaft;

a first moving unit that relatively moves the chucking shafts with respect to the processing tool;

a lens holding arm that is provided with first and second lens holders for holding the lenses;

a second moving unit that moves the lens holding arm; and a controller that controls the first and second moving units so that the first lens holder and the chucking shaft are moved to a first transfer position before and after the lens which is held by the first lens holder is processed, to transfer the lens therebetween, and, following the processing of the lens which is held by the first lens holder, the second lens holder and the chucking shaft are moved to a second transfer position, before and after the lens which is held by the second lens holder is processed, to transfer the lens therebetween.

(2) The eyeglass lens processing apparatus according to (1), wherein the lens holding arm is an arm which is provided with the first lens holder and the second lens holder at respectively different positions.

(3) The eyeglass lens processing apparatus according to (1), wherein the lens holding arm includes a first arm which is provided with the first lens holder, and a second arm which is provided with the second lens holder.

(4) The eyeglass lens processing apparatus according to (1), wherein each of the first and second lens holders includes a resilient member for holding a cup which is attached to the lens by resilient force thereof, the resilient member having an engaging portion to be engaged with an aligning portion which is formed in the cup.

(5) The eyeglass lens processing apparatus according to (4), wherein the controller controls the rotating unit to rotate the chucking shafts when the lenses held by the first and second lens holders are transferred.

(6) The eyeglass lens processing apparatus according to (1) further comprising a mode selecting unit that selects a mode in which the lenses held by the first and second lens holders are continuously processed.

(7) The eyeglass lens processing apparatus according to (1) further comprising:

a processing chamber in which the chucking shafts and the processing tool are arranged; and an opening and closing cover for covering the processing chamber, wherein the second moving unit moves the lens holding arms so as to position the first and the second lens holders inside and outside the processing chamber, respectively, and the cover is opened and closed in association with the movement of the arm.

(8) An eyeglass lens processing apparatus comprising:

a processing tool that processes a periphery of an eyeglass lens;

a lens chucking shaft that holds the lens;

a rotating unit that rotates the chucking shaft;

a first moving unit that relatively moves the chucking shaft with respect to the processing tool;

a lens holding arm provided with first and second lens holders which hold the lenses;

a second moving unit that moves the lens holding arm; and a controller that controls the second moving unit so that the first lens holder are moved to a first transfer position before and after the lens which is held by the first lens holder has been processed, to transfer the lens therebetween, and, following the processing of the lens which is held by the first lens holder, the second lens holder and the chucking shaft are moved to a second transfer position before and after the lens which is held by the second lens holder has been processed, to transfer the lens therebetween, wherein each of the first and second lens holders includes an elastic member for holding a cup which is attached to the lens by elastic force thereof, the elastic member having an engaging portion to be engaged with an aligning portion which is formed in the cup.

(9) An eyeglass lens processing apparatus according to (8), wherein the controller controls the rotating unit to rotate the chucking shafts, when the lenses held by the first and second lens holders are transferred.

DETAILED DESCRIPTION OF PREFERRED EMBODIMENTS

Figure 1:
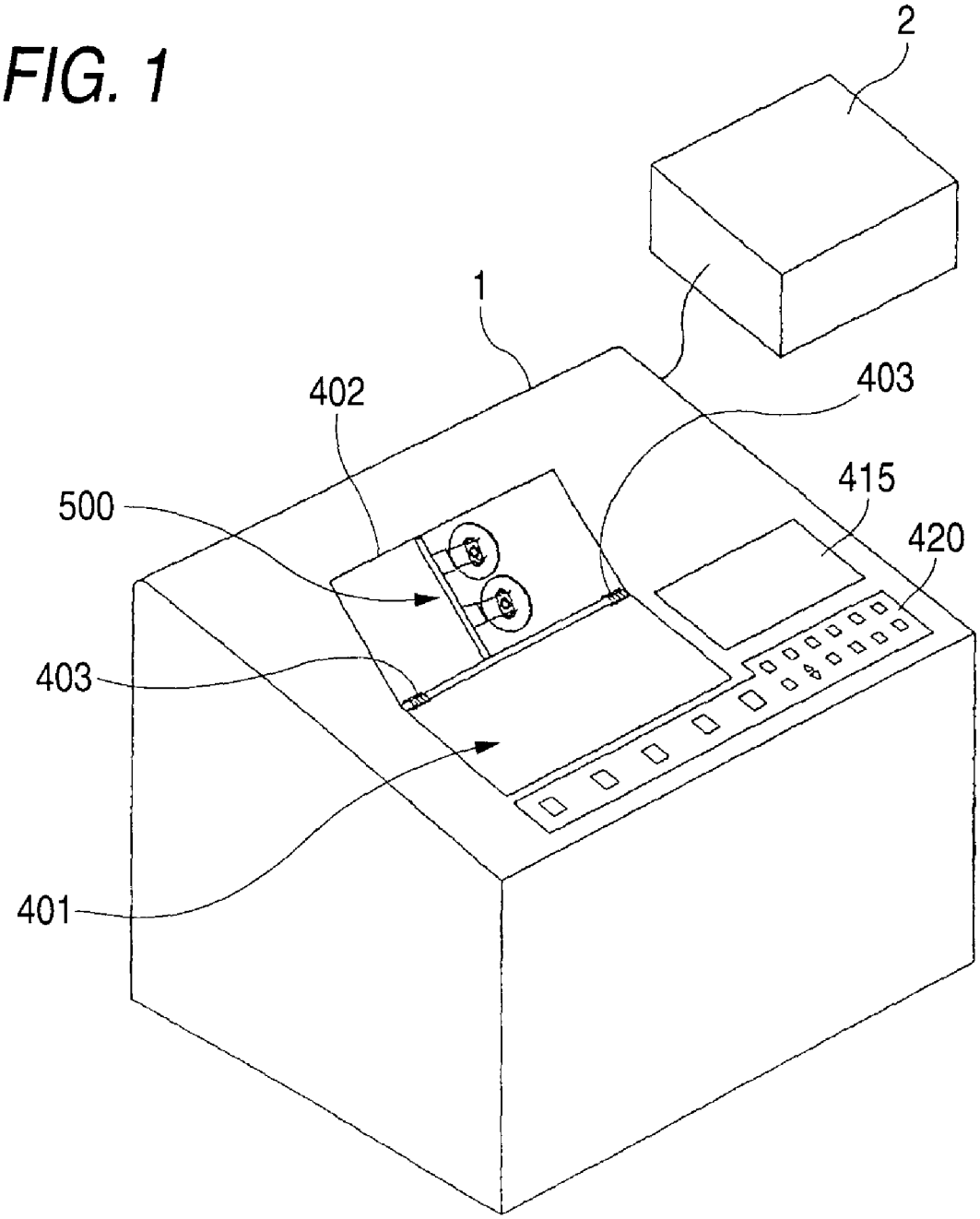
FIG. 1 is a schematic view showing an outer appearance of an eyeglass lens processing apparatus according to an embodiment of the invention.

Now, embodiments of the invention will be described referring to the drawings. FIG. 1 is a schematic view showing an outer appearance of an eyeglass lens processing apparatus 1 in an embodiment of the invention. An eyeglass frame measuring device 2 is connected to the processing apparatus 1. As the eyeglass frame measuring device 2, those measuring devices as described in U.S. Pat. No. 5,333,412 (Japanese Patent Publication No JP-A-4-93164), U.S. Re. 35898 (Japanese Patent Publication No. JP-A-5-212661), for example, can be used. A display portion 415 for displaying processing data and soon, and a switch portion 420 having switches for inputting processing conditions or so and for giving processing instructions or so are provided at an upper part of the processing apparatus 1. Lens to be processed is processed in a processing chamber 401 inside an opening and closing cover 402. It is to be noted that the processing apparatus 1 may be integrally formed with the measuring device 2.

Figure 2:
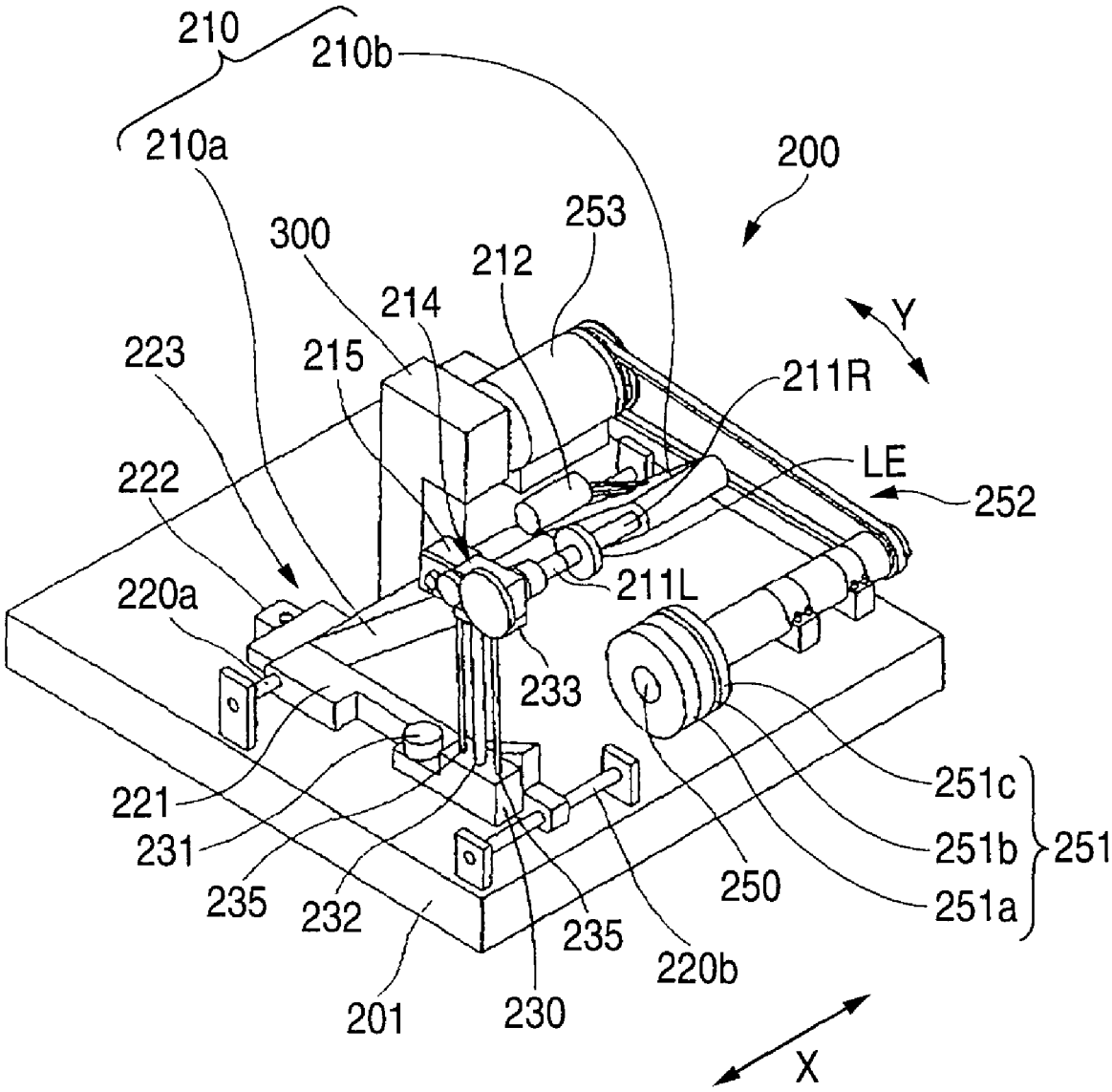
FIG. 2 is a schematic view showing a structure of a lens processing portion.

FIG. 2 is a schematic view showing a structure of a lens processing portion 200 which is arranged in a casing of the processing apparatus 1. A lens LE to be processed is held (chucked) between lens chucking shafts 211L and 211R which are rotatably held by a carriage 210, and is rotated so as to be ground by a grindstone 251. The grindstone 251 in this embodiment includes a roughing grindstone 251*a* for glass, a roughing grindstone 251*b* for plastic, and a grindstone 251*c* for bevel-finishing and flat-finishing. A grind stone rotating shaft 250 to which the grindstone 251 is mounted is rotated by a grindstone rotating motor 253 through a rotation transmitting mechanism 252 which includes a pulley attached to a rotation shaft of the motor 253, a belt and a pulley attached to the shaft 250.

The lens chucking shafts 211L and 211R are held by the carriage 210 in such a manner that their center axis (a rotation center axis of the lens LE) may be in parallel with a center axis of the shaft 250 (a rotation center axis of the grindstone 251). The carriage 210 can move in a direction of the center axis of the shaft 250 (a direction of the center axis of the chucking shafts 211L and 211R) (a direction of X), and also in a direction where an axis-to-axis distance between the center axis of the chucking shafts 211L and 211R and the center axis of the shaft 250 is varied (a direction of Y).

<Lens holding (chucking) mechanism>

The chucking shaft 211L is held on a left arm 210*a* of the carriage 210, and the chucking shaft 211R is held on a right arm 210*b* of the carriage 210, rotatably and coaxially. A cup receiver 240 to which a cup 50 attached to the lens LE is mounted is fixed to a distal end of the chucking shaft 211L, and a lens chucker 245 is fixed to a distal end of the chucking shaft 211R (See FIG. 3). A lens chucking motor 212 is fixed to the right arm 210*b*. Rotation of the motor 212 is transmitted to the chucking shaft 211R through a rotation transmitting mechanism (not shown) which includes a pulley attached to a rotation shaft of the motor 212, a belt, and so on, and a rotation-rectilinear movement converting mechanism (not shown) which includes a ball screw, a nut, and so on, whereby the chucking shaft 211R is moved in its axial direction. Along with this movement, the chucking shaft 211R is moved in a direction of approaching the chucking shaft 211L, and the lens LE is held (chucked) between the chucking shafts 211L and 211R.

<Lens rotating mechanism>

A lens rotating motor 215 is fixed to the left arm 210*a*. Rotation of the motor 215 is transmitted to the chucking shaft 211L through a rotation transmitting mechanism 214 which includes a gear attached to a rotation shaft of the motor 215, a gear attached to the chucking shaft 211L and so on, whereby the chucking shaft 211L is rotated. The rotation of the motor 215 is also transmitted to the chucking shaft 211R through a rotation transmitting mechanism (not shown) which includes a rotation shaft connected to the rotation shaft of the motor 215 and provided with a gear, a gear attached to the chucking shaft 211R, and soon, where by the chucking shaft 211R is rotated. In this manner, both the chucking shafts 211L and 211R is synchronously rotated, and the lens LE which is held (chucked) between them is rotated.

<Moving mechanism for the carriage 210 in the X direction>

Guide shafts 220*a* and 220*b* are fixed to a base 201 in parallel with each other, extending in the X direction, and a moving support base 221 is movably supported by the guide shafts 220*a* and 220*b*. Moreover, the carriage 210 which is connected to the support base 221 is movably supported by the guide shaft 220*a*. A motor 222 for movement in the X direction is fixed to the base 201, and rotation of the motor 222 is transmitted to the support base 221 through a rotation-rectilinear movement converting mechanism 223 which includes a pinion gear attached to a rotation shaft of the motor 222, a rack gear fixed to a rear part of the support base 221, and soon, whereby the support base 221 is moved in the X direction. In this manner, the carriage 210 connected to the support base 221 is moved in the X direction.

<Moving mechanism for the carriage 210 in the Y direction>

The carriage 210 is rotatably supported by the guide shaft 220*a*. Moreover, a rotating support base 230 is rotatably mounted to the support base 221 so as to rotate around an axis consistent with the center axis of the shaft 250. A motor 231 for movement in the Y direction is fixed to the support base 230, and rotation of the motor 231 is transmitted to a ball screw 232 which is rotatably held on the support base 230, through a rotation transmitting mechanism (not shown) which includes a pulley attached to a rotation shaft of the motor 231, a belt and so on. Along with the rotation of the ball screw 232, a moving support base 233 which is rotatably fitted to the left arm 210*a*, and to which the ball screw 232 is screwed is moved along two guide shafts 235 which are fixed to the support base 230 in parallel with each other and extend in a direction perpendicular to the X direction. Accordingly, the carriage 210 which is connected to the support base 233 is moved (rotated) in the Y direction around the guide shaft 220*a*. Further, a spring, which is not shown, is provided between the carriage 210 and the support base 221, and the carriage 210 is always urged downwardly by the spring.

Figure 3:
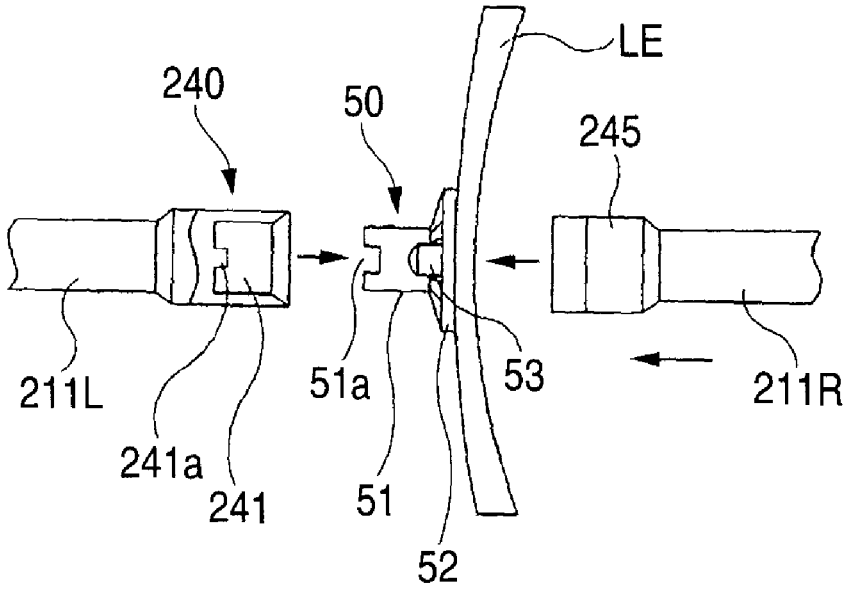
FIG. 3 is a view showing an example of holding a lens by lens chucking shafts.
Figure 4:
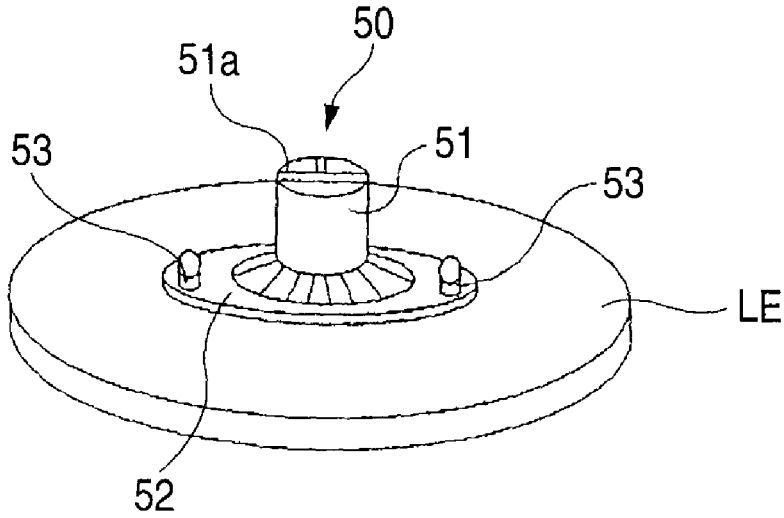
FIG. 4 is a schematic view showing a structure of a cup to be attached to the lens.

FIG. 3 is a view showing how the lens LE is held between the chucking shafts 211L and 211R. In order to hold the lens LE between the chucking shafts 211L and 211R, the cup 50 is previously attached to a front refractive face of the lens LE by means of a double faced adhesive tape. The cup 50 has a base portion 51 to be inserted into an insertion hole 241 of the cup receiver 240, and a flange portion 52 (See FIG. 4). Moreover, a key groove 51*a* is formed in the base portion 51. When this key groove 51*a* is engaged with a key 241*a* which is formed in the insertion hole 241, the cup 50 which has been attached to the lens LE in a state where an astigmatic axis of the lens LE has been aligned in position (in direction) is mounted on the chucking shaft 211L. Then, the chucking shaft 211R is moved in the direction of approaching the chucking shaft 211L, and the lens chucker 245 is butted against a rear refractive face of the lens LE, whereby the lens LE is held (chucked) between the chucking shafts 211L and 211R.

The flange portion 52 of the cup 50 has an oval shape, and two projections 53 acting as alignment members are formed on an upper face of the flange portion 52. The projections 53 are formed in a determined direction with respect to a direction of the key groove 51*a* (in a direction consistent with the direction of the key groove 51*a*, in this embodiment), and in a determined positional relation (symmetrically with respect to a center axis of the cup 50, in this embodiment). The projections 53 are provided for the purpose of being engaged with a cup detaching tool when the cup 50 is detached from the lens LE. However, the projections 53 also serve to hold the lens LE, when the lens LE is aligned in position and mounted on lens holders 530 and 540 in a lens exchanging portion 500, which will be described below.

A lens shape measuring portion 300 is arranged in a backward area of the carriage 210.

Figure 5:
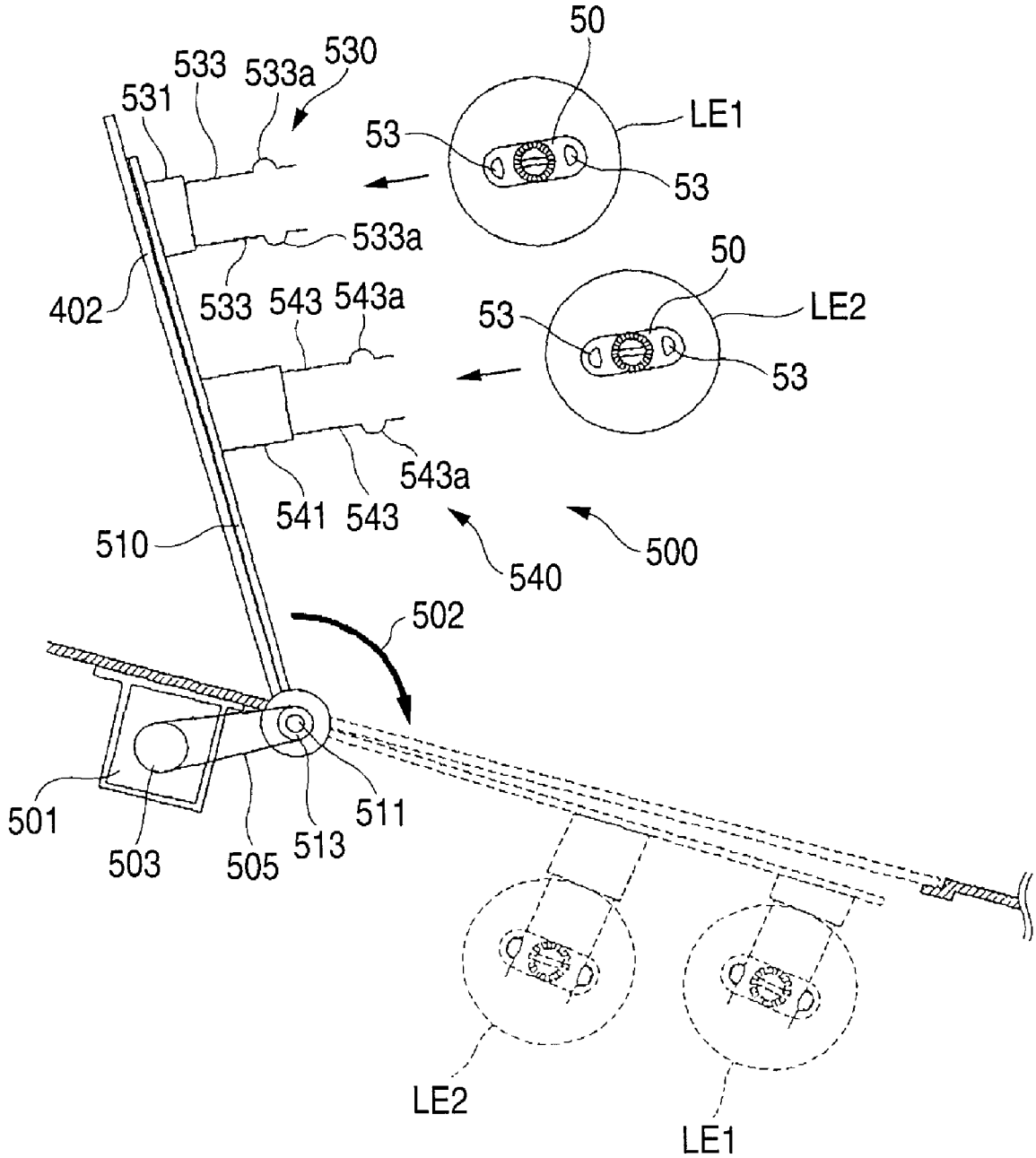
FIG. 5 is a schematic view showing a structure of a lens exchanging portion.
Figure 6:
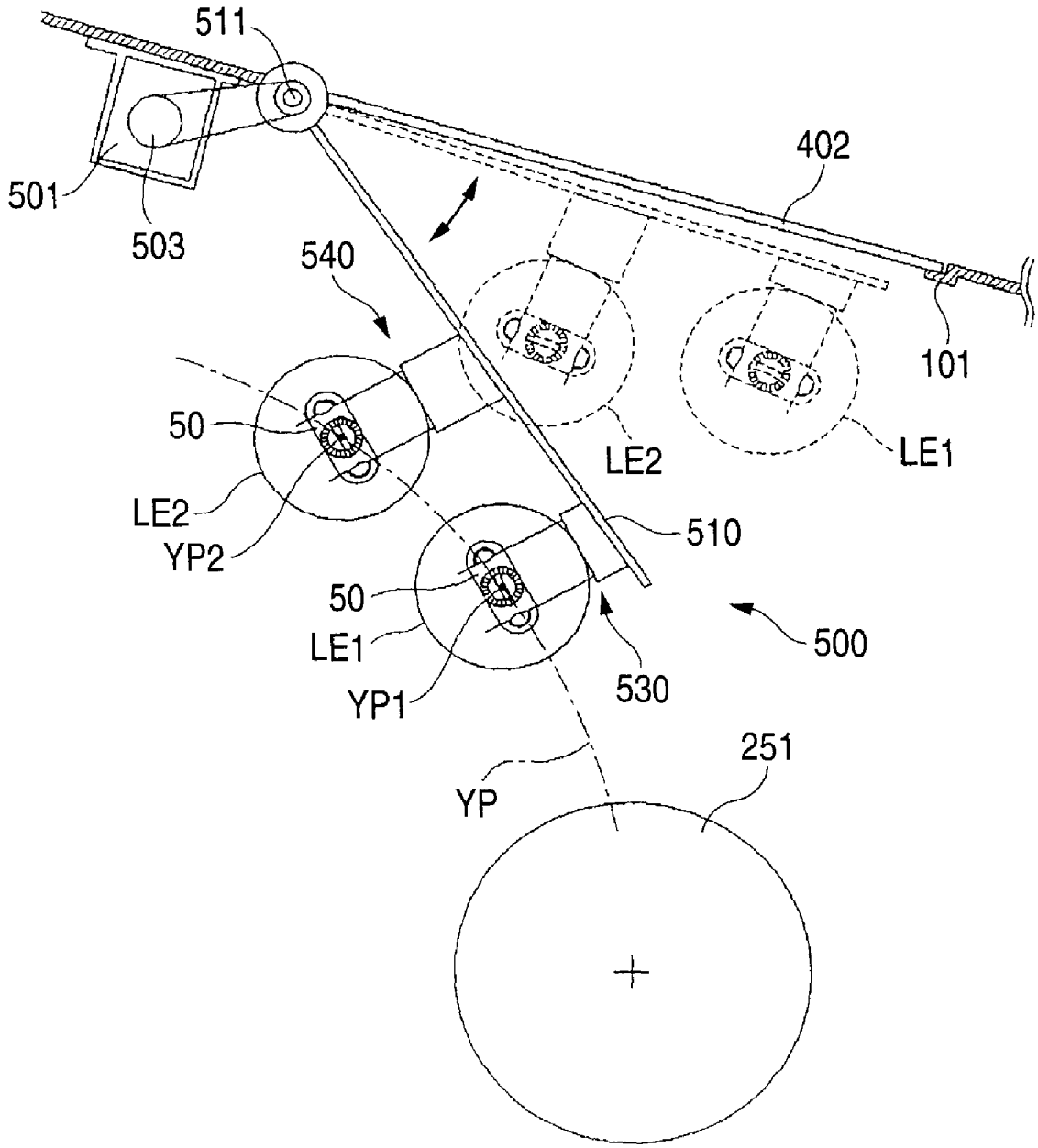
FIG. 6 is a schematic view showing the structure of the lens exchanging portion.

FIGS. 5 and 6 are schematic views showing a structure of the lens exchanging portion 500. FIG. 5 is a view in a state where the cover 402 is opened, as seen from a left side, and FIG. 6 is a view in a state where the cover 402 is closed, as seen from the left side.

A lens holding arm 510 is provided with the lens holder 530 which holds the lens LE for a left eye (hereinafter, referred to as a lens LE1) and the lens holder 540 which holds the lens LE for a right eye (hereinafter, referred to as a lens LE2). The holding arm 510 is fixed to a rotation shaft 511 which is rotatably held by the casing of the processing apparatus 1. Moreover, an arm moving motor 501 is fixed to the casing of the processing apparatus 1, and rotation of the motor 501 is transmitted to the rotation shaft 511 through a pulley 503 attached to a rotation shaft of the motor 501, a belt 505, and a pulley 513 attached to the rotation shaft 511, whereby the rotation shaft 511 is rotated. Accordingly, the lens holding arm 510 is rotated.

The holder 530 has a support member 531 fixed to the arm 510, and two elastic members 533 in a form of springs or the like which are fixed to the support member 531. The elastic members 533 are respectively formed with two recesses 533*a* opposed to each other, which are engaging portions to be engaged with the projections 53 of the cup 50. When the lens LE1 is mounted on the holder 530, the projections 53 of the cup 50 attached to the lens LE are engaged with the recesses 533*a*, and the cup 50 is held by elastic forces of the elastic members 533, whereby the lens LE1 is aligned in position and mounted on the holder 530. A structure of the holder 540 is essentially the same as that of the holder 530. The holder 540 has a support member 541 and two elastic members 543, and the elastic members 543 are respectively formed with two recesses 543*a* opposed to each other.

Installing positions of the holders 530 and 540 provided on the arm 510 are determined so that the center axes of the cups 50 attached to the lenses LE1 and LE2 may be positioned at positions YP1 and YP2 on a moving locus YP of the center axis of the chucking shafts 211L and 211R by the rotary movement of the carriage 210 (the chucking shafts 211L and 211R) in the Y direction, as shown in FIG. 6.

Figure 7:
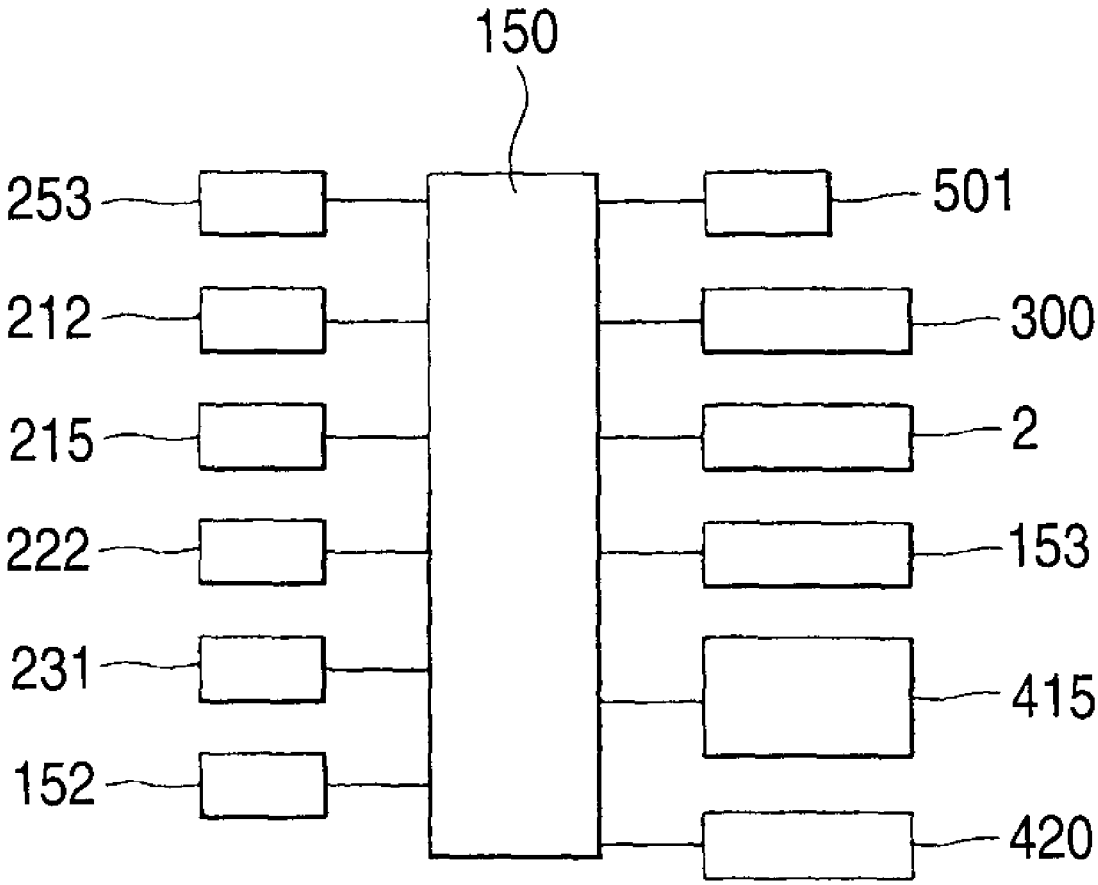
FIG. 7 is a schematic block diagram of a control system in the apparatus.

Operation of the apparatus having the structure as described above will be explained, referring to the schematic block diagram of the control system in FIG. 7. As a first step, the cups 50 are respectively attached to a pair of the left and right lenses LE1 and LE2 using a known blocking device (cup attaching device). In case where the lens LE1 and/or the lens LE2 have an astigmatic axis, the cup 50 is attached so that the key groove 51*a* of the cup 50 may be consistent with a direction of the astigmatic axis. In this manner, a direction of the two projections 53 is also aligned with the direction of the astigmatic axis of the lens LE1 and/or the lens LE2. An operator mounts and holds the lens LE1 equipped with the cup 50, on the holder 530. On this occasion, the base portion 51 and the projections 53 of the cup 50 are entered between the elastic members 533, as shown in FIG. 5, and the lens LE1 is rotated thereby to allow the projections 53 to be engaged with the recesses 533*a*. In this manner, the lens LE1 is held by the elastic forces of the elastic members 533. Moreover, by engaging the projections 53 with the recesses 533*a*, the center axis of the cup 50 and the astigmatic axis of the lens LE1 are aligned in position with respect to the holder 530 in a determined positional relation, and held. The other lens LE2 is also mounted on the holder 540, and held in the same manner.

Before or after the above described operation, shapes of left and right rims of an eyeglass frame are measured by the measuring device 2, and data of their target lens shapes is obtained. In case of a rimless frame or the like, a shape of a template and a shape of a dummy lens is measured, and data of its target lens shape is obtained. The data of the target lens shape obtained from the measuring device 2 is inputted into the processing apparatus 1 by switching a transfer switch in the switch portion 420, and is stored in a memory 152. When the data of the target lens shape has been inputted (stored), a figure of the target lens shape based on the target lens shape data is displayed on the display portion 415. Then, the operator operates the switch portion 420 and inputs layout data such as an FPD (a distance between geometric centers of the left and right rims), a PD (a distance between pupils) of a wearer, a height of an optical center with respect to a geometric center of the target lens shape. In addition, the operator operates the switch portion 420, and sets (input) material for the lens LE, a type of the eyeglass frame, processing mode, etc. By setting these processing conditions, processing steps is determined by the controller 150 based on a program which has been previously stored in the memory 153.

In case of continuously processing lenses by exchanging the lenses in the lens exchanging portion 500, the operator operates a mode switch in the switch portion 420 to select a continuous processing mode. On the other hand, in case where the operator exchanges the lenses in a conventional manner, the operator operates the mode switch in the switch portion 420 to select a sole processing mode. A case where the continuous processing mode has been selected will be described below.

When a processing starting switch in the switch portion 420 is pressed, the controller 150 controls the rotation of the motor 501 thereby to rotate the arm 510 in a direction of an arrow mark 502 (downward movement). In association with the downward movement of the arm 510, the cover 402 is also rotated in the direction of the arrow mark 502 so as to be closed (downward movement) by urging force of a spring 403 (See FIG. 1). The downward movement of the cover 402 is stopped at a position for keeping tight sealing, when a distal end of the cover 402 comes into contact with a restricting portion 101 (See FIG. 6) which is formed in the casing of the processing apparatus 1. The arm 510 is further rotated downwardly, and is stopped, when the center axis of the cup 50 attached to the lens LE1 which is held by the holder 530 has arrived at the transfer position YP1 of the lens LE1.

Sequentially, the controller 150 controls the rotation of the motor 231 thereby to rotate the carriage 210 (the chucking shafts 211L and 211R) in the Y direction (downward movement), thereby allowing the center axes of the chucking shafts 211L and 211R to be positioned at the transfer position YP1. In order to position the chucking shafts 211L and 211R at the position YP1, the controller 150 keeps the chucking shafts 211L and 211R in an open position (an initial position). The controller 150 also controls the rotation of the motor 222 thereby to move the carriage 210 (the chucking shafts 211L and 211R) in the X direction, so that the lens LE1 may be positioned between the cup receiver 240 and the lens chucker 245. Moreover, the controller 150 controls the rotation of the motor 215 thereby to rotate the chucking shafts 211L and 211R, whereby the direction of the key 241*a* of the cup receiver 240 is made consistent with the direction of the key groove 51*a* of the cup 50 which is held by the holder 530. In this state, the controller 150 controls the rotation of the motor 222 thereby to move the carriage 210 (the chucking shafts 211L and 211R) in the X direction, and stops the carriage 210 at a position where the base portion 51 of the cup 50 is inserted into the cup receiver 240. At the same time, the controller 150 controls the rotation of the motor 212 thereby to move the chucking shafts 211R in the direction of approaching the chucking shaft 211L, thereby allowing the lens LE1 to be held (chucked) between the chucking shafts 211L and 211R.

Then, the controller 150 controls the rotation of the motor 215 thereby to rotate the chucking shafts 211L and 211R by a determined angle (for example, 90 degree) in a state where the lens LE1 is held (chucked) between them. Along with this operation, the projections 53 of the cup 50 are disengaged from the recesses 533*a* of the holder 530. Specifically, the projections 53 of the cup 50 are rotated against elastic forces of the elastic members 533, and the lens LE1 (the cup 50) is removed from the holder 530, whereby transfer of the lens LE1 to the chucking shafts 211L and 211R is completed.

After the transfer of the lens LE1 to the chucking shafts 211L and 211R has been completed, the controller 150 controls the rotation of the motor 501 there by to rotate (upward movement) the arm 510 up to a retreat position in the processing chamber 401 which is shown by a dotted line in FIGS. 5 and 6. Moreover, the controller 150 calls up the target lens shape data and the layout data corresponding to the lens LE1 which is held by the holder 530, from the memory 152, and actuates the shape measuring portion 300 according to these data, thereby to obtain the shapes (edge positions) of the front and back refractive faces of the lens LE1. Then, on the basis of the shapes of the lens and the target lens shape data which have been thus obtained, processing data is obtained. On the basis of the obtained processing data, the rotation of the chucking shafts 211L and 211R, and the movement of the carriage 210 (the chucking shafts 211L and 211R) are controlled, whereby the roughing is performed by the grindstones 251*a* or 251*b*, and then, the finishing is performed by the grindstone 251*c*.

After the processing of the lens LE1 has been finished, the controller 150 transfers the lens LE1 which is held between the chucking shafts 211L and 211R to the holder 530, in a reverse operation to the above described. Specifically, the controller 150 controls the rotation of the motor 231 to rotate the carriage 210 (the chucking shafts 211 and 211R) in they direction (upward movement), thereby allowing the center axes of the chuck shaft 211L and 211R to be positioned at the position YP1, and also controls the rotation of the motor 215 to rotate the chucking shafts 211L and 211R so that the base portion 51 and the projections 53 of the cup 50 may enter between the elastic members 533. Then, the controller 150 controls the rotation of the motor 501 to move the arm 510 downwardly from the retreat position, thereby allowing the holder 530 to be positioned at the position YP1. When the rotation of the motor 215 is controlled to rotate the chucking shafts 211L and 211R by a determined angle (for example, 90 degree), the elastic members 533 are pressed with the rotation of the projections 53, and the projections 53 are engaged with the recesses 533*a*. Consequently, the lens LE1 is again mounted on the holder 530 and held. Thereafter, the controller 150 controls the rotation of the motor 212 to move the chucking shafts 211R in a direction of moving away from the chucking shaft 211L, and controls the rotation of the motor 222 to move the carriage 210 (the chucking shafts 211L and 211R) in the X direction so as to move the chucking shaft 211L in a direction of moving away from the cup 50. In this manner, the lens LE1 is released from the chucking shafts 211L and 211R, and the transfer of the lens LE1 to the holder 530 is completed.

Sequentially, the controller 150 moves the arm 510 downwardly, and stops the arm 510 when the center axis of the cup 50 attached to the lens LE2 which is held by the holder 540 is positioned at the transfer position YP2 of the lens LE2. The controller 150 moves the carriage 210 downwardly in the Y direction thereby to position the center axis of the chucking shafts 211L and 211R at the position YP2. Thereafter, in the same manner as the lens LE1, the lens LE2 is transferred to the chucking shafts 211L and 211R.

After the transfer of the lens LE2 to the chucking shafts 211L and 211R has been completed, the controller 150 moves the arm 510 upwardly up to the retreat position, and calls up the target lens shape data and the layout data corresponding to the lens LE2 which is held by the holder 540, from the memory 152. Then, the controller 150 actuates the measuring portion 300 according to these data, thereby to obtain the shapes (edge positions) of the front and back refractive faces of the lens LE2. Then, on the basis of the shapes of the lens and the target lens shape data which have been thus obtained, processing data is obtained. On the basis of the obtained processing data, the roughing and the finishing are conducted.

After the processing of the lens LE2 has been finished, transfer of the lens LE2 to the holder 540 is conducted in the same manner as the lens LE1. After the transfer of the lens LE2 to the holder 540 has been completed, the controller 150 controls the rotation of the motor 501 to move the arm 510 upwardly. When the arm 510 has moved upwardly beyond the retreat position in the processing chamber 401 to an outside of the processing chamber 401, the cover 402 is moved so as to be opened, in association with the upward movement of the arm 510. Finally, the arm 510 is opened to reach the position as shown in FIG. 5.

As described above, the operator need not have the left and right lenses LE1 and LE2 respectively held by the chucking shafts 211L and 211R one by one, and therefore, processing efficiency of the operator is enhanced. For example, while the two lenses are being processed, other operations can be conducted. In the above described embodiment, as the mechanism for transferring the lens LE between the chucking shafts 211L and 211R and the holders 530 and 540, the mechanism for moving the carriage 210 having the chucking shafts 211L and 211R in the X direction and Y direction is commonly used, and therefore, it is possible to move the arm 510 with the mechanism for moving in one direction. Moreover, as the mechanism for holding the lens LE by mounting it to the holder 530 or 540, the elastic members (533 or the like) which hold the cup 50 attached to the lens LE are employed, and therefore, a driving mechanism for holding the lens LE can be omitted.

As the lens processing portion (lens processing mechanism) in the processing apparatus 1, it is possible to move the shaft 250 of the grindstone 251 in the X direction, instead of moving the carriage 210 (the chucking shafts 211L and 211R) in the X direction. In such a case too, it would be sufficient to provide a mechanism for moving the arm 510 or the holders 530 and 540 in the X direction, in addition to the rotary movement of the arm 510. As for the movement of the chucking shafts 211L and 211R to the transfer positions YP1 and YP2, the mechanism for moving the carriage 210 (the chucking shafts 211L and 211R) in the Y direction can be commonly used.

Figure 8:
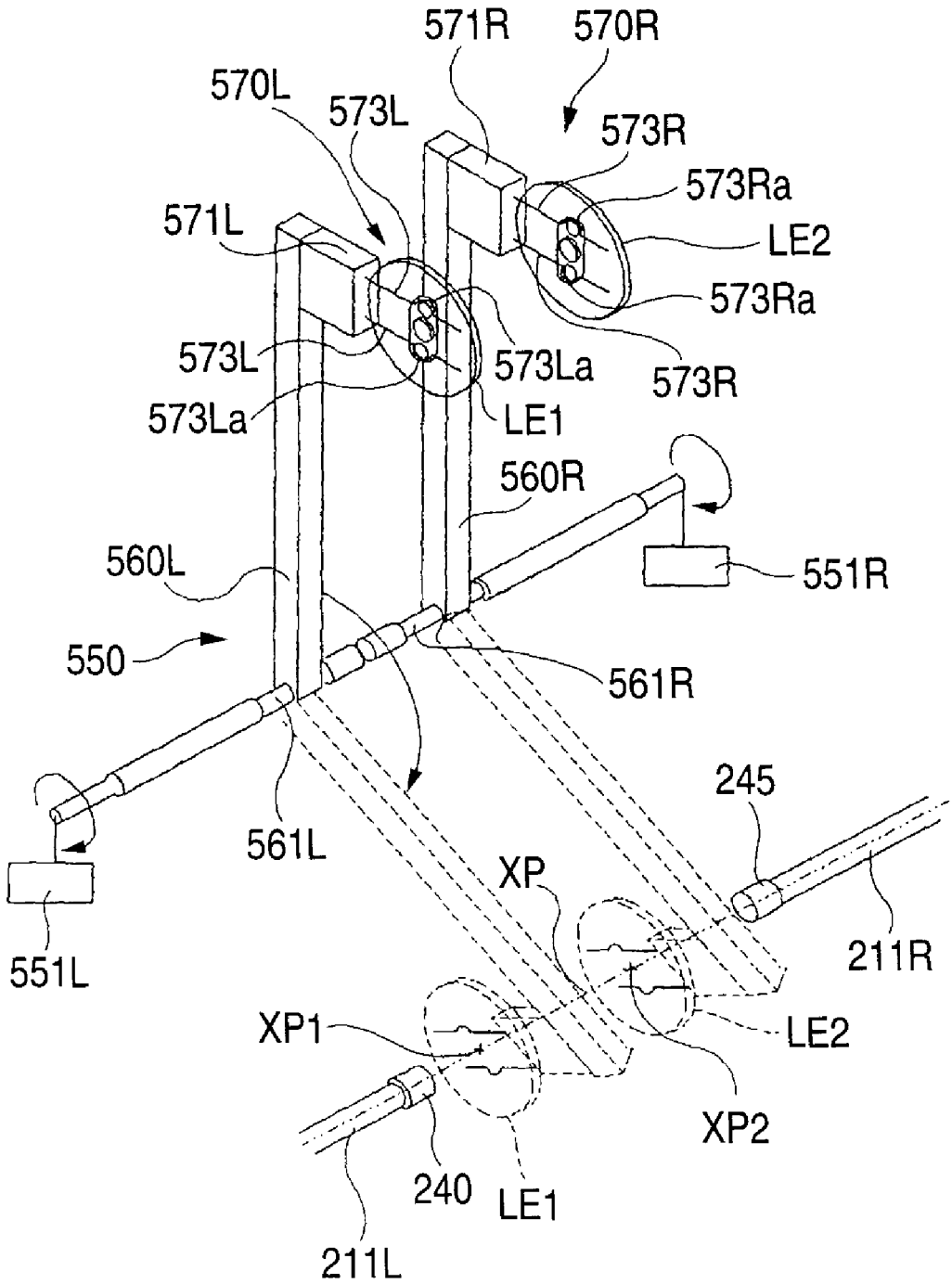
FIG. 8 is a schematic view showing a modified structure of the lens exchanging portion.

FIG. 8 is a schematic view showing a modified structure of the lens exchanging portion. A lens exchanging portion 550 in this embodiment is different from the embodiment in FIG. 5 in that a first lens holding arm provided with a lens holder and a second lens holding arm provided with a lens holder are provided so that two lenses can be moved independently.

A first lens holding arm 560L provided with a lens holder 570L which holds the lens LE1 is fixed to a rotation shaft 561L which is rotatably held by the casing of the processing apparatus 1. The rotation shaft 561L is rotated by a motor 551L through a rotation transmitting mechanism which is not shown. A structure of the lens holder 570L is essentially the same as that of the holder 530. The holder 570L has a support member 571L which is fixed to the arm 560L, and two elastic members 573L formed of springs or the like which are fixed to the support member 571L. The elastic members 573L are formed with two recesses 573La opposed to each other, as the engaging portions to be engaged with the projections 53 of the cup 50. On the other hand, a second lens holding arm 560R provided with a lens holder 570R which holds the lens LE2 is fixed to a rotation shaft 561R which is rotatably held by the casing of the processing apparatus 1. The rotation shaft 561R is rotated by a motor 551R through a rotation transmitting mechanism which is not shown. A structure of the holder 570R is essentially the same as that of the holder 570L, and description of the same will be omitted.

Installing position of the holder 570L provided on the arm 560L is set, as shown in FIG. 8, in such a manner that the center axis of the cup 50 attached to the lens LE1 which is held may be positioned at a position XP1 on a moving locus (the center axis) XP of the chucking shafts 211L and 211R, while the carriage 210 (the chucking shafts 211L and 211R) moves in the X direction. On the other hand, installing position of the holder 570R provided on the arm 560R is set in such a manner that the center axis of the cup 50 attached to the lens LE2 which is held may be positioned at a position XP2 on the moving locus XP.

In the structure as described above, its operation will be described. The operator mounts the lenses LE1 and LE2 provided with the cups 50 respectively on the holders 570L and 570R to be held. On this occasion, in the same manner as described above, the projections 53 of the cups 50 are allowed to be engaged with the recesses 573La and 573Ra.

When the processing starting switch has been pressed, the controller 150 controls the rotations of the respective motors to transfer the lens LE1. As a first step, the rotations of the motors 551L and 551R are controlled, whereby the first arm 560L and the second arm 560R are rotated to move (downward movements) up to the retreat position in the processing chamber 401. In association with the downward movements of the first arm 560L and the second arm 560R, the cover 402 is also rotated so as to be closed (downward movement). The first arm 560L is further rotated downwardly, and is stopped, when the center axis of the cup 50 attached to the lens LE1 which is held by the holder 570L has arrived at the transfer position XP1 of the lens LE1. The controller 150 controls the rotation of the motor 215 thereby to rotate the chucking shafts 211L and 211R, so that the direction of the key 241*a* of the cup receiver 240 may be consistent with the direction of the key groove 51*a* of the cup 50. In this state, the controller 150 controls the rotation of the motor 222 to move the carriage 210 (the chucking shafts 211L and 211R) in the X direction, and to stop the carriage 210 at a position where the base portion 51 of the cup 50 is to be inserted into the cup receiver 240. At the same time, the controller 150 controls the rotation of the motor 212 to move the chucking shafts 211R in the direction of approaching the chucking shaft 211L, thereby allowing the lens LE1 to be held (chucked) between the chucking shafts 211L and 211R. Thereafter, the lens LE1 (the cup 50) is removed from the holder 570L, by rotating the chucking shafts 211L and 211R by a determined angle, and the transfer of the lens LE1 to the chucking shafts 211L and 211R is completed.

After the processing for the lens LE1 has been completed, the lens LE1 which is held between the chucking shafts 211L and 211R is transferred to the holder 570L. Then, the second arm 560R is moved downwardly, and is stopped when the center axis of the cup 50 attached to the lens LE2 which is held by the holder 570R has arrived at the transfer position XP2 of the lens LE2. On this occasion, because the position XP2 is displaced from the position XP1 by a determined amount in the X direction, when the lens LE2 is transferred to the chucking shafts 211L and 211R, the movement of the carriage 210 (the chucking shafts 211L and 211R) in the X direction is controlled so that the transfer position may be changed by the amount of displacement. The transfer of the lens LE2 is conducted essentially in the same manner as that of the lens LE1, and description of the same will be omitted.

In this embodiment, as the mechanism for transferring the lens LE between the chucking shafts 211L and 211R and the holders 570L and 570R, the mechanism for moving the carriage 210 having the chucking shafts 211L and 211R in the X direction is commonly used. Therefore, it is needless to commonly use the mechanism for moving the carriage 210 in the Y direction. Moreover, the lens exchanging portion 550 in this embodiment can be also applied to such a structure that the grindstone 251 (the shaft 250) is adapted to move with respect to the lens LE (the chucking shafts 211L and 211R), instead of moving the lens LE (the chucking shafts 211L and 211R) with respect to the grindstone 251 (the shaft 250).

Additionally, in the lens exchanging portion 550 in FIG. 8, it is possible to process a number of lenses continuously with a simple structure, because two lenses can be moved using separate lens holding arms. Specifically, after the lens LE1 on the holder 570L has been processed, another lens LE1 is mounted and held on the holder 570L, while the lens LE2 on the holder 570R is processed. Then, after the lens LE2 on the holder 570R has been processed, another lens LE2 is mounted and held on the holder 570R, while the other lens LE1 on the holder 570L is processed. By repeating this operation, it is possible to enhance processing efficiency of the apparatus, and a number of lenses can be efficiently processed. In this case, the cover 402 may be so constructed as not to be mechanically moved in association with the rotary movements of the arms 560L and 560R. For example, left and right covers may be separately opened and closed, or alternatively, the arms 560L and 560R may be moved outward from the processing chamber 401 in a state where the cover 402 is closed.

Further, the lens exchanging portion 500 and the lens exchanging portion 550 may be combined. Specifically, two each of the holders 570L and 570R may be mounted on the first arm 560L and the second arm 560R in the lens exchanging portion 550. Moreover, the number of the arms may be increased. By employing such structures, processing efficiency is further enhanced.

Figure 9:
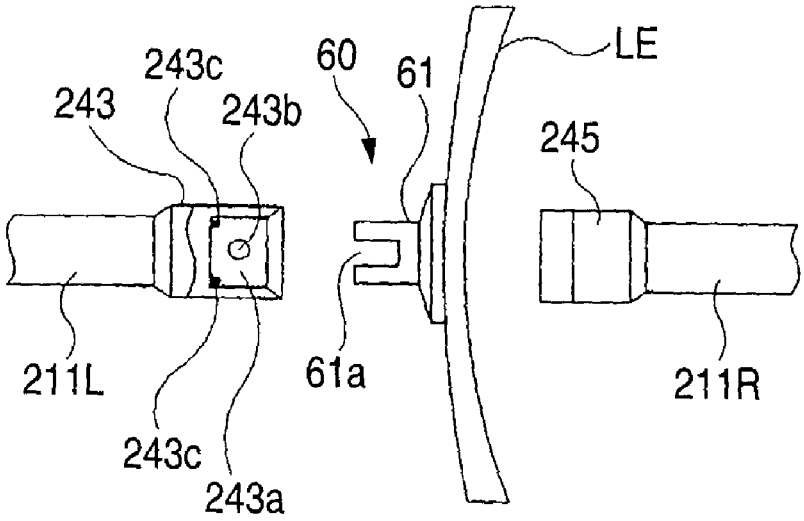
FIG. 9 is a view showing a modified example of holding the lens by the lens chucking shafts.
Figure 10:
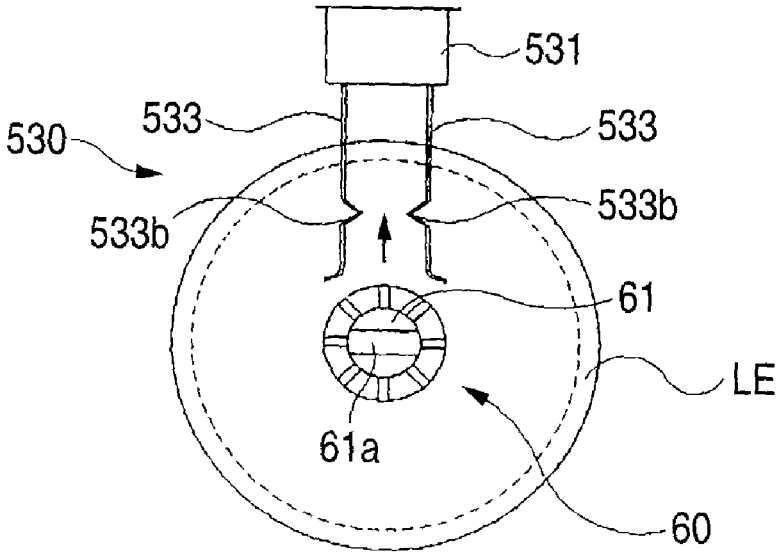
FIG. 10 is a view showing a modified example of a lens holder.

Although, in the above described embodiment, the cup 50 is provided with the projections 53 which are the aligning portions when the lens LE is mounted on the holder 530 and so on, the invention is not limited to this embodiment. For example, as shown in FIGS. 9 and 10, it is possible to use a cup 60 having a key groove 61*a* which is formed up to nearly a root of a base portion 61, as the aligning portion. In this case, a cup receiver 243 at the distal end of the chucking shaft 211L may be provided with an insertion hole 243*a* into which the base portion 61 is inserted, a pin 243*b* to be engaged with the key groove 61*a*, and springs 243*c* arranged in a bottom of the insertion hole 243*a*. On the other hand, the elastic members 533 of the holder 530 may be formed with two convex portions 533*b* opposed to each other, as the engaging portions to be engaged with the key groove 61*a*.

When the cup 60 fixed to the lens LE is inserted into the cup receiver 243, the carriage 210 (the chucking shafts 211L and 211R) is moved in the X direction until the key groove 61*a* is engaged with the pin 243*b*, and the chucking shaft 211R to which the lens chucker 245 is fixed is be moved in the direction of approaching the chucking shaft 211L. On this occasion, the carriage 210 (the chucking shafts 211L and 211R) is moved in the X direction up to a position where the key groove 61*a* can be disengaged from the convex portions 533*b*. Then, the chucking shafts 211L and 211R are rotated when the lens LE is held to a certain extent. In this manner, the key groove 61*a* of the cup 60 is disengaged from the convex portions 533*b*. In short, the lens LE (the cup 60) is removed from the holder 530. After the processing for the lens LE has been finished, the lens LE is transferred to the holder 530 in the reverse operations. On this occasion, as the chucking shaft 211R is moved a little in the direction away from the chucking shaft 211L, the cup 60 is also moved by spring force of the springs 243*c* in the cup receiver 243, and a gap is formed so that the convex portions 533*b* can be engaged with the key groove 61*a*. Thereafter, the holder 530 is moved to the determined transfer position, whereby the convex portions 533*b* are engaged with the key groove 61*a*, thus enabling the lens LE to be transferred.

As described above, various modifications can be added to the aligning portions, the engaging portions of the holders to be engaged with the aligning portions, and so on.

Although the grindstone is employed as the processing tool in this embodiment, it is possible to employ known lens periphery processing tools such as a cutter, and an end mill.

What is claimed is:

1. An eyeglass lens processing apparatus comprising:

a processing tool that processes a periphery of an eyeglass lens;

a lens chucking shaft that holds the eyeglass lens;

a rotating unit that rotates the chucking shaft;

a first moving unit that relatively moves the chucking shaft with respect to the processing tool;

a lens holding arm that is provided with first and second lens holders for holding the lenses;

a second moving unit that moves the lens holding arm; and a controller that controls the first and second moving units so that the first lens holder and the chucking shaft are moved to a first transfer position before and after the lens which is held by the first lens holder is processed, to transfer the lens therebetween, and, following the processing of the lens which is held by the first lens holder, the second lens holder and the chucking shaft are moved to a second transfer position, before and after the lens which is held by the second lens holder is processed, to transfer the lens therebetween.

2. The eyeglass lens processing apparatus according to claim 1, wherein the lens holding arm is an arm which is provided with the first lens holder and the second lens holder at respectively different positions.

3. The eyeglass lens processing apparatus according to claim 1, wherein the lens holding arm includes a first arm which is provided with the first lens holder, and a second arm which is provided with the second lens holder.

4. The eyeglass lens processing apparatus according to claim 1, wherein each of the first and second lens holders includes a resilient member for holding a cup which is attached to the lens by resilient force thereof, the resilient member having an engaging portion to be engaged with an aligning portion which is formed in the cup.

5. The eyeglass lens processing apparatus according to claim 4, wherein the controller controls the rotating unit to rotate the chucking shaft when the lenses held by the first and second lens holders are transferred.

6. The eyeglass lens processing apparatus according to claim 1 further comprising a mode selecting unit that selects a mode in which the lenses held by the first and second lens holders are continuously processed.

7. The eyeglass lens processing apparatus according to claim 1 further comprising:

a processing chamber in which the chucking shaft and the processing tool are arranged; and an opening and closing cover for covering the processing chamber, wherein the second moving unit moves the lens holding arm so as to position the first and the second lens holders inside and outside the processing chamber, respectively, and the cover is opened and closed in association with the movement of the arm.

8. An eyeglass lens processing apparatus comprising:

a processing tool that processes a periphery of an eyeglass lens;

a lens chucking shaft that holds the lens;

a rotating unit that rotates the chucking shaft;

a first moving unit that relatively moves the chucking shaft with respect to the processing tool;

a lens holding arm provided with first and second lens holders which hold the lenses;

a second moving unit that moves the lens holding arm; and a controller that controls the second moving unit so that the first lens holder is moved to a first transfer position before and after the lens which is held by the first lens holder has been processed, to transfer the lens therebetween, and, following the processing of the lens which is held by the first lens holder, the second lens holder is moved to a second transfer position before and after the lens which is held by the second lens holder has been processed, to transfer the lens therebetween, wherein each of the first and second lens holders includes an elastic member for holding a cup which is attached to the lens by elastic force thereof, the elastic member having an engaging portion to be engaged with an aligning portion which is formed in the cup.

9. An eyeglass lens processing apparatus according to claim 8, wherein the controller controls the rotating unit to rotate the chucking shaft, when the lenses held by the first and second lens holders are transferred.

* * * * *